US010648737B2

(12) United States Patent
Lonardi et al.

(10) Patent No.: US 10,648,737 B2
(45) Date of Patent: May 12, 2020

(54) HEAT PROTECTION ASSEMBLY FOR A CHARGING INSTALLATION OF A METALLURGICAL REACTOR

(71) Applicant: Paul Wurth S.A., Luxembourg (LU)

(72) Inventors: Emile Lonardi, Bascharage (LU); Serge Devillet, Grevenmacher (LU)

(73) Assignee: PAUL WURTH S.A., Luxembourg (LU)

( * ) Notice: Subject to any disclaimer, the term of this patent is extended or adjusted under 35 U.S.C. 154(b) by 15 days.

(21) Appl. No.: 15/315,351

(22) PCT Filed: Jun. 4, 2015

(86) PCT No.: PCT/EP2015/062511

§ 371 (c)(1),
(2) Date: Nov. 30, 2016

(87) PCT Pub. No.: WO2015/185695

PCT Pub. Date: Dec. 10, 2015

(65) Prior Publication Data

US 2017/0198971 A1 Jul. 13, 2017

(30) Foreign Application Priority Data

Jun. 6, 2014 (LU) ..... 92472

(51) Int. Cl.
*F27D 3/06* (2006.01)
*F27D 1/00* (2006.01)
(Continued)

(52) U.S. Cl.
CPC ..... *F27D 3/06* (2013.01); *F23M 5/02* (2013.01); *F27B 1/20* (2013.01); *F27D 1/0033* (2013.01)

(58) Field of Classification Search
CPC ..... F27D 3/06; F27B 1/20; F27B 3/18; F27B 3/24
See application file for complete search history.

(56) References Cited

U.S. PATENT DOCUMENTS 2,099,829 A * 11/1937 Smith ..... F23M 5/08 105/423
2,127,842 A * 8/1938 Hosbein ..... F27D 1/004 52/415

(Continued)

FOREIGN PATENT DOCUMENTS

CN 2881290 Y 3/2007
CN 101046323 A 10/2007

(Continued)

OTHER PUBLICATIONS

EP Office Action dated Oct. 27, 2017 re: Application No. 15 729 377.0-1373; pp. 1-5; citing: WO 2014/187659 A1.

(Continued)

*Primary Examiner* — Nathaniel Herzfeld
(74) *Attorney, Agent, or Firm* — Cantor Colburn LLP

(57) ABSTRACT

The invention relates to a heat protection assembly (2, 30) for a charging installation (1) of a metallurgical reactor. In order to increase the lifetime of a heat protection shield in a charging installation of a metallurgical reactor, the assembly (2, 30) comprises a plurality of heat protection tiles (31.1, 31.2, 31.3, 31.4) disposed adjacent to each other along a surface The assembly further comprises a plurality of heat protection panels (10, 110), each panel (10, 110) comprising a common base plate (11, 111) to which a plurality of tiles (31.1, 31.2, 31.3, 31.4) are connected, which heat protection panels (10, 110) are configured to be mounted on the charging installation (1) adjacent to each other.

12 Claims, 2 Drawing Sheets

(51) Int. Cl.
*F23M 5/02* (2006.01)
*F27B 1/20* (2006.01)

(56) References Cited

U.S. PATENT DOCUMENTS

| | | | | | |
|---|---|---|---|---|---|
| 2,132,419 | A * | 10/1938 | Jacobus | F23M 5/00 | 122/235.12 |
| 2,144,598 | A * | 1/1939 | Brinckerhoff | F23M 5/00 | 110/336 |
| 2,315,833 | A * | 4/1943 | Youker | F27D 1/06 | 110/336 |
| 2,321,813 | A * | 6/1943 | Henzel | F27D 1/06 | 110/336 |
| 2,867,112 | A * | 1/1959 | Krone | F23R 3/007 | 109/83 |
| 2,870,624 | A * | 1/1959 | Sampson | F27D 1/004 | 110/331 |
| 3,589,316 | A * | 6/1971 | Longenecker | F23M 5/06 | 110/332 |
| 4,045,168 | A * | 8/1977 | Abrial | F27D 1/0009 | 432/247 |
| 4,376,805 | A * | 3/1983 | Esnoult | C04B 35/657 | 264/135 |
| 5,163,831 | A * | 11/1992 | Hammond | F27D 1/004 | 110/336 |
| 6,258,315 | B1 | 7/2001 | Araki et al. | | |
| 6,390,268 | B1 * | 5/2002 | Lonardi | C21B 7/20 | 193/16 |
| 7,540,710 | B2 * | 6/2009 | Grote | C21B 7/06 | 415/200 |
| 2001/0034986 | A1 * | 11/2001 | Thomas | B28B 19/00 | 52/211 |
| 2017/0146295 | A1 * | 5/2017 | Tockert | F27B 3/24 | |

FOREIGN PATENT DOCUMENTS

| | | | |
|---|---|---|---|
| CN | 101684985 | A | 3/2010 |
| CN | 202630692 | U | 12/2012 |
| DE | 19807590 | A1 | 8/1999 |
| EP | 0449736 | A1 | 10/1991 |
| EP | 1528343 | A1 | 5/2005 |
| EP | 1640461 | A2 | 3/2006 |
| FR | 2537708 | A1 | 6/1984 |
| JP | 5328206 | U | 3/1978 |
| JP | 59116305 | A | 7/1984 |
| JP | 11335711 | A | 12/1999 |
| JP | 2007238975 | A | 9/2007 |
| TW | 393562 | B | 6/2000 |
| WO | 2012016902 | A1 | 2/2012 |
| WO | 2014187659 | A1 | 11/2014 |

OTHER PUBLICATIONS

International Preliminary Report on Patentability dated Aug. 24, 2016 re: Application No. PCT/EP2015/062511; pp. 1-14; citing: DE 198 07 590 A1, FR 2 537 708 A1, EP 0 449 736 A1, EP 1 528 343 A1 and EP 1 640 461 A2.

International Search Report dated Aug. 17, 2016 re: Application No. PCT/EP2015/062511; pp. 1-4; citing: DE 198 07 590 A1, FR 2 537 708 A1, EP 0 449 736 A1, EP 1 528 343 A1 and EP 1 640 461 A2.

Written Opinion dated Aug. 17, 2016 re: Application No. PCT/EP2015/062511; pp. 1-6; citing: DE 198 07 590 A1, FR 2 537 708 A1, EP 0 449 736 A1, EP 1 528 343 A1 and EP 1 640 461 A2.

CN Office Action dated Jan. 24, 2018 re: Application No. 2015800279582; pp. 1-14; citing: JP S59116305 A and CN 101684985 A.

Examination Report dated Mar. 23, 2018 re: Application No. 104117928, pp. 20, citing: TW 393562, JP 2007-238975, JP 59-116305 A, CN 101046323 A, CN 101684985 A and DE 19807590 A1.

CN Office Action dated Nov. 6, 2018 re: Application No. 2016-570301, pp. 1-6, citing: CN 202630692, JP 1999-335711 and CN 2881290.

JP Office Action dated Feb. 26, 2019 re: Application No. 2016-570301, pp. 1-6, citing: JP 1999-35711, CN 202630692, JP 1978-028206 and CN 2881290.

* cited by examiner

HEAT PROTECTION ASSEMBLY FOR A CHARGING INSTALLATION OF A METALLURGICAL REACTOR

TECHNICAL FIELD

The invention relates to a heat protection assembly for a charging installation of a metallurgical reactor. It further relates to a charging installation of a metallurgical reactor.

BACKGROUND ART

Metallurgical reactors are well-known in the art. These reactors are typically gravity-fed from above by a charging installation, which in turn may be fed with bulk material from intermediate hoppers. One type of charging installation is disclosed in international application WO 2012/016902 A1. Here, the material is fed through a feeder spout, which is positioned above the inlet of a distribution chute. The chute is mounted on a rotatable tubular support, in which the feeder spout is disposed. To provide for a two-dimensional mobility of the chute, it is also tiltable relative to the support by shafts connected to a gear assembly. The gear assembly is positioned inside a gearbox formed by the support and a stationary casing on which the support is rotationally mounted. For protection of the gear assembly, the bottom portion of the casing has a heat protection shield with a cooling circuit. The shield defines a central opening in which a lower portion of the support is disposed. Since the heat protection shield may be subjected to relatively high temperatures and considerable temperature changes, while there may be also high temperature gradients, there may be a need for inspection, maintenance and/or replacement of the shield or at least of parts thereof. This in particular refers to the cooling circuit, but also to a heat protection layer of refractory material, which is disposed on the underside of the cooling circuit. While a charging installation of the above-mentioned application generally works well, maintenance of the heat protection shield is often complicated and time-consuming. Repair of a damaged refractory layer can only be performed by guniting or shot screening when the reactor is shut down. A platform needs to be introduced into the upper part of the reactor. This makes the work not only tedious, but also dangerous.

BRIEF SUMMARY

The disclosure seeks to increase the lifetime of a heat protection shield in a charging installation of a metallurgical reactor. This is accomplished by a heat protection assembly as described herein.

A heat protection assembly for a charging installation of a metallurgical reactor is provided herein. The metallurgical reactor may in particular be of the blast furnace type. A charging installation will generally be of the type where the bulk material is gravity-fed to the reactor. Therefore, in these cases, the charging installation is—at least for the larger part—intended to be installed above the reactor. The heat protection assembly will usually be configured to protect a reactor side surface of the charging installation, i.e. in the above-mentioned case, the bottom surface. The assembly comprises a plurality of heat protection tiles disposed adjacent to each other along a surface and also comprises a plurality of heat protection panels. The surface along which the tiles are disposed may be plane, bent or other. The term "surface" herein is to be understood in a geometrical way, i.e. it does not necessarily have to be the physical surface of a device. Each tile is heat-protective in that it is heat-resistant, in particular fire-resistant, and has by its geometry some shielding capacity. Each tile normally comprises a refractory material. Heat resistance may be desired up to about 1200° C. as such temperatures may be reached in case of an incident.

A gap may be provided between adjacent tiles. The gap allows for a thermal expansion of the individual tiles. The thermal stress within an individual tile is therefore relatively small compared to the stress in a monolithic refractory layer. The size of the gap may be chosen according to the expected thermal expansion of the tiles under the operating conditions of the charging installation. The tiles may be allowed to touch each other when the top temperatures of the installation are reached, since the thermal stress in such a case is still less than with a monolithic structure. On the other hand, the size of the gap at room temperature can be chosen so that it will not close even at top temperatures. However, the size of the gap should not be too great, since this could negatively affect the shielding properties of the heat protection assembly. It is possible that the tiles overlap, e.g. like a tongue and groove, so that an expansion of the tiles is possible while heat convection through the gap is hindered. It is also within the scope of the invention that some material is placed within the gap as long as this material does not hinder the thermal expansion of the individual tiles too much. For example, the material may be highly compressible.

According to a preferred embodiment, the tiles comprise a support structure on which a refractory material is disposed. Such as support structure forms a kind of "backbone" of the tile. Normally, the support structure will be made of material that is highly resistant to thermal expansion and contraction processes, i.e. the material is very unlikely to form cracks under these processes. It goes without saying that the material should have a melting point that is considerably higher than the expected temperatures during operation of the charging installation. Possible materials are ceramic or metals, for example steel. The refractory material, which is disposed on the support structure, of course has to be highly heat resistant and flame resistant. Preferably, it is a poor heat conductor. The latter property is not so crucial for the support structure. On the other hand, the refractory material does not have to be as resistant to thermal deformation processes, because even if small cracks form in the refractory material, it may still be held in place by the connection to the support structure.

It is preferred that the refractory material can be cast onto or around the support structure. I.e., the refractory material should be applicable in a liquid or semi-liquid form, which solidifies after application to the support structure. One such material which is preferred is refractory concrete.

This also opens the possibility of forming the gap by placing a kind of "spacer" material in the position of the intended gap before casting the refractory material. The spacer material may be removed after the casting process before the tile is installed to the charging installation. Alternatively, the gap may be filled with a material which is volatile under the operating temperatures of the metallurgical reactor. I.e. the spacer material is volatile and can be left in place during installation of the tile. "Volatile" in this context refers to materials that will melt and/or evaporate as well as materials which disappear due to a chemical reaction at high temperatures, usually due to combustion. Of course, since the only function of the material is to provide a kind of "die" for the casting process of the refractory material and the spacer material is lost during operation of the reactor, cheap materials are preferred for this purpose. For example, wood-based or paper materials can be used. A particularly preferred material is cardboard.

Preferably, the support structure comprises a mesh on which the refractory material is disposed. The mesh structure, which may be essentially two-dimensional or three-dimensional, helps to cover a large space with relatively little material. Depending on the material used for the support structure, this may help to keep the weight and/or the cost of the tile low. Also, since the heat conductivity of the support structure is often higher than that of the refractory material, it is desirable to use as little support structure as possible.

There are a multitude of different mesh configurations which may be used. Some may be essentially two-dimensional, like wire mesh. Especially when the thickness of the tile is greater, three-dimensional structures will be preferred. According to one preferred embodiment, the mesh is hexagonal. The hexagonal structure is preferably disposed along the plane of the tile, so that the support structure resembles a honeycomb.

The heat protection assembly comprises a plurality of heat protection panels, each panel comprising a common base plate to which a plurality of tiles are connected, which heat protection panels are configured to be mounted on the charging installation adjacent to each other. The connection of the tiles to the base plate may be a detachable or permanent one. The same materials which can be used for the support structure may also be used for the base plate. In fact, it is even conceivable that the base plate and the support structures are formed as one piece. In a subsequent casting process, the refractory material can be applied to the support structures. It is preferred that the heat protection panels are configured to be detachably mounted on the charging installation.

In this context it is herein provided a heat protection assembly for a charging installation of a metallurgical reactor, which assembly comprises a plurality of heat protection panels, which heat protection panels are configured to be mounted on the charging installation adjacent to each other, wherein each panel at least comprises a heat protection layer. The layer may be disposed on a base plate and may further comprise a plurality of tiles, which are connected to the base plate. By such a heat protection assembly, the installation and maintenance of a heat protection shield in a charging installation is facilitated.

In a preferred embodiment, the panel comprises spacer members, which define a space separating the tiles from the base plate. The space mainly serves two purposes. On the one hand, the thermal contact between the tiles and the base plate is reduced. On the other hand, such a gap also allows for thermal expansion perpendicular to the surface along which the tiles are disposed. The spacer members normally are disposed on the side of the tile which faces the base plate and extend perpendicular to the above-mentioned surface.

While the space separating the tiles from the base plate could be just filled with air, it is preferred that a heat insulation layer is disposed between the base plate and the tiles. Such an heat insulation layer generally reduces the heat conduction of the assembly and in particular reduces convection flow via the gaps between the tiles. A variety of materials, which are known in the art, can be used for the heat insulation layer. It is particularly preferred to use at ceramic fiber material.

In nearly any case, the elements of the charging installation which are protected by the heat protection assembly also require some cooling circuit. According to preferred in embodiment, parts of such cooling circuit can be installed on the heat protection panel. In this case, each heat protection panel comprises at least one coolant channel. Such a coolant channel can be provided by a conventional pipe and/or by a channel which is provided within the base plate. In the described embodiment, the heat protection and the cooling system are both designed in a modular way, which allows very easy mounting and dismounting of individual panels for inspection, repair or replacement. It should also be noted that such inspection, maintenance and/or replacement may be carried out from inside the charging installation.

A heat protection panel is further provided for a charging installation of a metallurgical reactor, with a plurality of heat protection tiles disposed adjacent to each other along a surface and connected to a common base plate, wherein a gap is provided between adjacent tiles. These elements have been described above with respect to the inventive heat protection assembly. Preferred embodiments of the heat protection panel correspond to those of the heat protection assembly.

Moreover, a charging installation of a metallurgical reactor is provided, with a heat protection assembly, which comprises a plurality of heat protection tiles disposed adjacent to each other along a surface, wherein a gap is provided between adjacent tiles. It is understood that the surface is normally on a reactor side of the charging installation, i.e. a side which faces the reactor.

Preferred embodiments of the charging installation correspond to the embodiments of the heat protection assembly as described above.

The charging installation may in particular comprise a casing for a gear assembly. Here, the heat protection assembly is configured to protect an annular bottom surface of the casing. Of course in this case, the bottom surface of the casing is facing the reactor. Such a configuration is also disclosed in WO 2012/016902 A1, which is hereby included by reference. Here, a conventional heat shield is employed, though. The gear assembly is part of a tilting mechanism for a distribution chute of the charging installation. The casing may also be considered as a gearbox, since it forms a housing for the gear assembly. However, the gear assembly is able to rotate within the housing.

It is highly preferred that the heat protection panels are mountable and dismountable from inside the casing. Since the casing usually has an access door for maintenance of the gear assembly or the like, the inside is easily accessible. If connection means like bolts are accessible from the inside, mounting or dismounting of the panels can be performed easily and safely.

If the heat protection assembly comprises a plurality of heat protection panels as described above, the panels are usually too heavy to be handled manually. Therefore, some kind of hoist needs to be applied. While it is possible to introduce such a device into the casing for each maintenance operation and take it out again afterwards, it is preferred that a hoist device for handling the panels is disposed (or mounted) inside the casing. One example for such a hoist device is a gantry crane. In an annular casing as the one shown in WO 2012/016902 A1, the gantry crane may comprise an annular beam disposed near the top of the casing. It may thus be placed above any section of the casing to lift any panel located on the bottom.

BRIEF DESCRIPTION OF THE DRAWINGS

Details of the invention will now be described with reference to the drawings, wherein.

DESCRIPTION OF PREFERRED EMBODIMENTS

Figure 1:
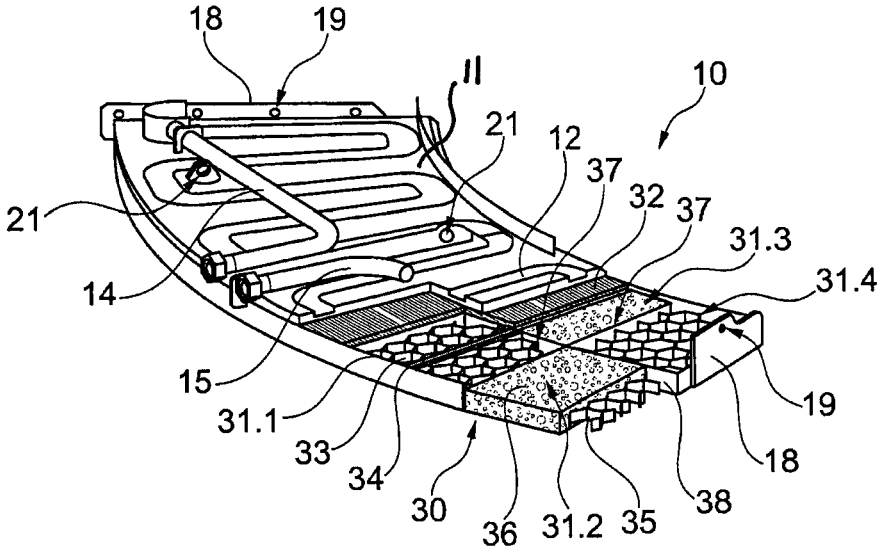
FIG. 1 is perspective cut-away view of a first embodiment of the heat protection panel.

FIG. 1 shows a cut-away view of a heat protection panel 10, which is used for protecting a reactor-side bottom section of a charging installation of a metallurgical reactor. The bottom section to be protected could, for instance, belong to the housing for a gear assembly of a distribution device as described in WO 2012/016902 A1. This bottom section is annular; therefore it can be covered by arc-shaped panels 10. The shape of the panel 10 is largely determined by the base plate 11, which is made of steel. A meandering coolant channel 12 is disposed in the base plate 11 and is covered by a cover plate, which is welded to the base plate 11. The cover plate may have a meandering structure following the meandering structure of the coolant channel 12. If there is a deformation of the base plate 11, there is a movement in the coolant channel 12. With a cover plate closely replicating the shape of the coolant channel 12, it is possible to reduce the risk of the weld between the cover plate and the base plate 11 breaking, as the cover plate will follow the movement of the coolant channel 12. A supply pipe 14 and a drainpipe 15 are connected to the channel 12 and can be used for connection to a coolant supply. The base plate 11 carries a plurality of heat protection tiles 31.1, 31.2, 31.3, 31.4, which form a heat protection layer 30. Each of the heat protection tiles 31 is connected to the base plate 11 via knob-like spacer members 34 is, which are disposed on a mounting strip 33. A hexagonal mesh 35 is connected to the mounting strip 33. The mesh 35 serves as a backbone of the heat protection tiles 31 and provides for structural integrity. The heat protection properties of the tile 31 mainly result from a block of refractory concrete 36 which is cast around the mesh 35. The tiles 31.1, 31.2, 31.3, 31.4 do not touch each other, but are provided with the gap 37 in between. This gap 37 allows for thermal expansion during operation of the heat protection layer 30.

In the production process the mounting strip 33 with the mesh 35 is mounted to the base plate 11 before the refractory concrete 36 is applied. A strip of cardboard 38 is placed between the individual tiles 31.1, 31.2, 31.3, 31.4 to prevent concrete 36 from entering the gap 37. The refractory concrete 36 is then cast around the mesh 35. The cardboard 38 could be removed prior to installation of the panel 10, but this is not necessary. The cardboard 38 will quickly burn away under the operating conditions of the panel 10 and thus can be left within the gap 37, as shown in FIG. 1. The spacer members 34 provide for a space between the tile and the base plate 11, which space is filled with the heat insulation layer 32 composed of ceramic fibers. The heat protection panel 10 therefore is a module which combines three functional layers: the heat protection layer 30 with tiles 31.1, 31.2, 31.3, 31.4 protects against extreme temperatures and also provides thermal insulation, the insulation layer 32 further enhances the insulation effect, while the coolant channel 12 with the pipes 14, 15 provides for active cooling. The panel 10 is provided with side flanges 18, which extend perpendicular to the plane of the base plate 11. These side flanges 18 are provided with a plurality of through-holes 19 and are used to connect the panel 10 to neighboring panels and/or the charging installation. Three eyelets 21 are disposed on the upper side of the base plate 11, which facilitate handling of the panel 10 and by a hoist 41 or the like.

Figure 2:
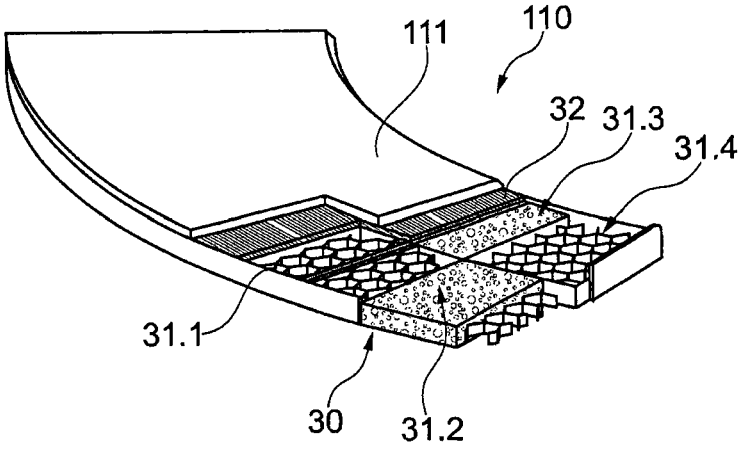
FIG. 2 is a perspective cut-away but of a second embodiment of the heat protection panel.

FIG. 2 shows an alternative embodiment of an inventive panel 110. In this case, a simple base plate 111 without any channel structures has been employed, while the heat protection layer 30 and the heat insulation layer 32 are identical to the embodiment shown in FIG. 1. The panel 110 could be used in the case where no active cooling is necessary or it could be combined with a separate cooling system.

Figure 3:
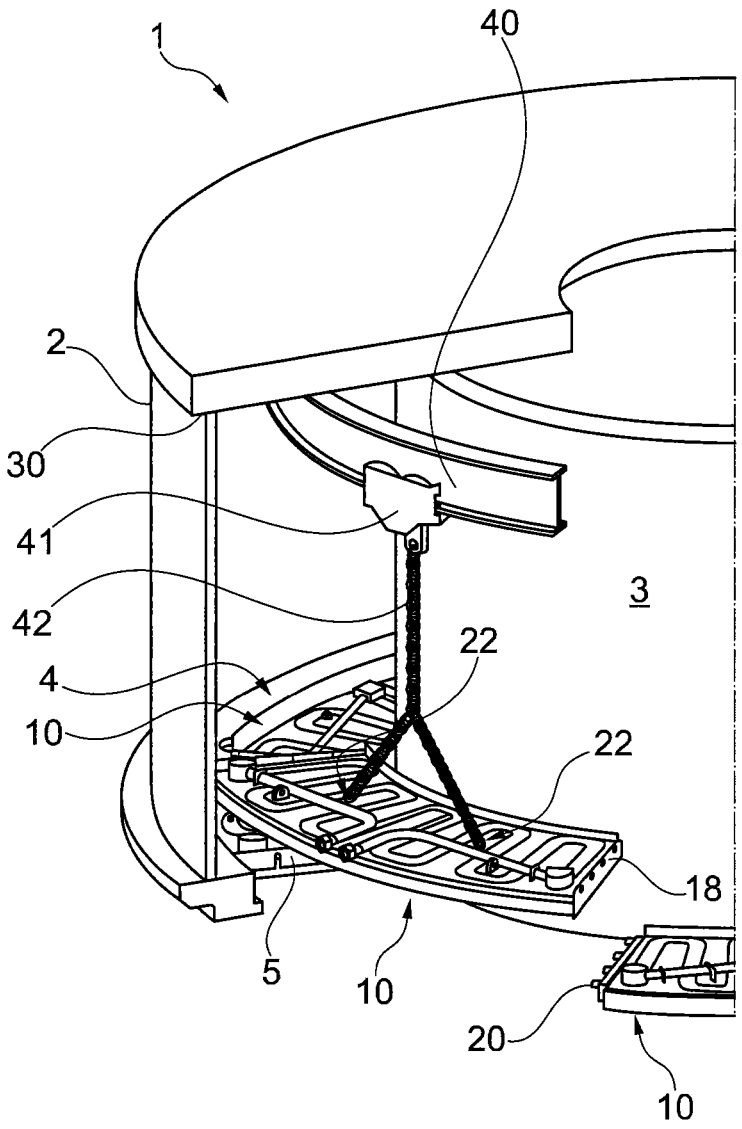
FIG. 3 is a perspective cutaway view of a charging installation in which the heat protection panel of FIG. 1 is used.

FIG. 3 shows a perspective cutaway view of a charging installation 1, which features an annular shaped casing 2 for a gear assembly and a cylindrical support 3 for the gear assembly. The gear assembly, which is not shown here, is used for tilting of a distribution chute of the charging installation 1. The support 3 is rotatably mounted with respect to the casing 2. As can be seen from FIG. 3, a plurality of heat protection panels 10 as shown in FIG. 1 are disposed next to each other along the annular bottom of the casing 2. Bolts 20, which are put through the holes 19, are used to connect each side flange 18 to a radially disposed plate-like mounting member 5 of the casing 2. At the same time, the bolts 20 serve to interconnect the individual panels 10.

As can be seen in FIG. 3, a beam 40 of a gantry crane 41 is connected to the top of the casing 2. The beam 40 is annular-shaped and allows the crane 41 to be moved to virtually any position within the casing 2. FIG. 3 illustrates the removal of a heat protection panel 10, which is lifted by a chain 42 of the gantry crane 41. FIG. 3 shows the chain connected to hoist rings 22, which are not shown in FIG. 1. Alternatively, the chain 42 could be connected to the eyelets 21. By moving the gentry crane 41 along the beam 40, the heat protection panel 10 may be moved to an access door (not shown) of the casing 2, from where it may be removed for repair or replacement. A replacement panel can be installed by a reverse sequence of operations. It is therefore apparent that a replacement of the heat protection panel 10 can be achieved in short time and easily. In particular, there is no need for personnel to work on the underside of the heat protection assembly 4, i.e. near or within the reactor itself. The mounting and dismounting can be done from within the casing 2. This makes the work not only easier but also significantly adds to the safety of the working personnel.

The invention claimed is:

1. A charging installation of a metallurgical reactor comprising an annular bottom section with a heat protection assembly, the heat protection assembly comprising a plurality of heat protection tiles disposed adjacent to each other along a surface and comprising a plurality of heat protection panels, each panel comprising a common base plate to which a plurality of tiles are connected such that the base plate carries the plurality of heat protection tiles, wherein a gap is provided between adjacent tiles, which heat protection panels are configured to be removably mounted on the charging installation adjacent to each other.

2. The charging installation according to claim 1, wherein the tiles comprise a support structure on which a refractory material is disposed.

3. The charging installation according to claim 2, wherein the refractory material is refractory concrete.

4. The charging installation according to claim 1, wherein the gap is filled with a material which is volatile under the operating temperatures of the metallurgical reactor.

5. The charging installation according to claim 4, wherein said volatile material is cardboard.

6. The charging installation according to claim 2, wherein the support structure comprises a mesh on which the refractory material is disposed.

7. The charging installation according to claim 6, wherein the mesh is hexagonal.

8. The charging installation according to claim 1, wherein spacer members define a space separating the tiles from the base plate.

9. The charging installation according to claim 8, wherein a heat insulation layer is disposed between the base plate and the tiles.

10. The charging installation according to claim 1, wherein each heat protection panel comprises at least one coolant channel.

11. The charging installation according to claim 1, further comprising a casing for a gear assembly and wherein the heat protection assembly is configured to protect an annular bottom surface of the casing.

12. The charging installation according to claim 1, wherein the panel is provided with side flanges, which extend perpendicular to the plane of the base plate to connect the panel to neighbouring panels and/or the charging installation.

* * * * *